United States Patent [19]

Scholl et al.

[11] 4,411,143

[45] Oct. 25, 1983

[54] LAUNDRY TREATMENT MACHINE

[75] Inventors: Michael Scholl, Poing; Herbert Klassen, Fürstenfeldbruck, both of Fed. Rep. of Germany

[73] Assignee: Bosch-Siemens Hausgeräte GmbH, Stuttgart, Fed. Rep. of Germany

[21] Appl. No.: 279,527

[22] Filed: Jul. 1, 1981

[30] Foreign Application Priority Data

Jul. 2, 1980 [DE] Fed. Rep. of Germany ..... 3025088

[51] Int. Cl.[3] ..... D06F 21/04; D06F 33/02

[52] U.S. Cl. ..... 68/12 R; 68/13 R; 68/140; 73/862.54; 177/144; 177/211

[58] Field of Search ..... 68/12 R, 13 R, 139, 68/140; 73/862.54; 177/144, 211

[56] References Cited

U.S. PATENT DOCUMENTS 3,798,931 3/1974 Czech et al. ..... 68/3 R
4,117,719 10/1978 Schutz ..... 73/862.54
4,168,160 9/1979 Stoferle et al. ..... 73/862.54 X

FOREIGN PATENT DOCUMENTS 2034847 1/1972 Fed. Rep. of Germany ..... 68/13 R
2920492 12/1979 Fed. Rep. of Germany ..... 68/12 R
2844755 4/1980 Fed. Rep. of Germany ..... 68/12 R
54-147661 11/1979 Japan ..... 68/12 R

*Primary Examiner*—Philip R. Coe
*Attorney, Agent, or Firm*—Herbert L. Lerner; Laurence A. Greenberg

[57] ABSTRACT

Laundry treatment machine including a housing, a carrier disposed in the housing, a laundry drum rotatably supported by the carrier, the carrier having parts thereof being exposed to loads affected by the weight of the drum, electro-mechanical transducers being disposed on the parts of the carrier and producing output signals representing a measure of the weight and the weight change of the drum, and a signal processing device receiving the output signals.

7 Claims, 4 Drawing Figures

LAUNDRY TREATMENT MACHINE

The invention relates to a laundry treatment machine with a laundry drum which is rotatably supported in a carrier within a housing.

Washing machines are known to have provisions for the determination of the laundry-weight. In a washing machine described in U.S. Pat. No. 24 12 270, there is provided a spring loaded switch which operates in conjunction with a hinged front door, and turns on an indicator light when the maximum pre-determined dry weight of the laundry collected on the front door is reached. However, such a laundry scale which is an integral part of a washing machine can only indicate a certain amount of laundry, and has no influence on the program form of the following wash cycle or program.

In another known washing machine described in German Published, Prosecuted Application, DE-AS 11 57 578, a controllable setting device is provided for automatically setting the water level in dependence on the amount of laundry, which however must be also determined outside of the machine. Mechanical or hydromechanical devices of this type for the automatic consideration of the amount of laundry are, to begin with, not precise, and become even less reliable because of the deposition of dirt and/or scale deposits, and/or washing agent deposits. Furthermore, they require a costly addition of extra parts.

Furthermore, a washing machine is known from German Published, Non-Prosecuted Application DE-OS 20 34 847 which includes a pressure-sensitive, electrochemical transducer, that is connected as a resistor in an electrical bridge circuit. Due to its resistance change at a pressure variation, this transducer causes an imbalance of the measuring bridge, and supplies a signal to a control circuit that is proportional to weight-change. The measuring principle of this kind in and of itself makes it possible to completely automatically measure and evaluate the weight increase of the washing machine caused by the loaded laundry. However, the ratio of the weight of approximately 100 kg, for example, of the washing machine itself, to the small weight addition of approximately 0.5 to 5 kg, is not suited for achieving sufficiently accurate measurable effects for the control circuit.

It is accordingly an object of the invention to provide a laundry treatment machine which overcomes the hereinafore-mentioned disadvantages of the heretofore-known devices of this general type, and one which makes it possible to sense and evaluate the weight increase due to the laundry load fully automatically, and which operates accurately enough, so that a weight increase can be sensed with a disturbance or resolution of 0.1 kg, for example.

With the foregoing and other objects in view there is provided, in accordance with the invention, a laundry treatment machine comprising a housing, a carrier disposed in the housing, a laundry or washing drum rotatably supported by the carrier, the carrier having parts thereof being exposed to loads being especially noticeably affected by the weight of the drum, electromechanical transducer being disposed on the parts of the carrier and producing output signals representing a measure of the weight and/or the weight change of the drum, and a signal processing device receiving the output signals.

In accordance with another feature of the invention, the electro-mechanical transducers are strain gauges, or tension measuring strips.

In accordance with a further feature of the invention, said electro-mechanical transducers are piezo-electric pressure sensors. According to the invention the strain-gauge or transducer is attached at a part of the drum carrier, and therefore only the weight of the drum of approximately 5 kg and the weight of the laundry filled-in of additionally about 0.5 to 5 kg are acting on the transducer. Therefore, the ratio of its own weight to the weight of the laundry which is between 10:1 and 1:1 is much more favorable than in devices in the known state of art with ratios of 200:1 and 20:1. Such a relative or proportional large increase also permits the registration of small weight increases. Furthermore, because of the sufficiently precise resolution, it is possible to exactly adjust all parameters of the following wash operation to the existing laundry load.

In accordance with an added feature of the invention, the carrier includes a drum container for the drum and members connecting the drum to the drum container, at least one of the strain gauges being attached to the connecting members. Generally, there are connecting elements provided which are individually manufactured, and can already be provided with the required strain gauge before the assembly of the machine.

In accordance with an additional feature of the invention, the just-described feature is recommended wherein the drum container has a rear wall, the laundry drum has a pivot shaft, and the carrier includes a star-shaped support member and lugs fastening the support member to the rear wall for supporting the pivot shaft, at least one of the strain gauges being attached to the lugs.

In accordance with again another feature of the invention, for the case in which the fastening elements for the star-shaped support member having a different configuration, the drum container has a rear wall, the laundry drum has a pivot shaft, and the carrier includes a star-shaped support member having spokes and a bearing housing and being fastened to the rear wall for supporting the pivot shaft, the strain gauges being provided in even numbered amounts and being attached in pairs to at least one of the spokes and bearing housing in such a way that each strain gauge of a pair is loaded with opposite effect relative to the other strain gauge of the pair by the weight of the drum.

In accordance with again a further feature of the invention, each of the spokes have a first side facing toward and a second side facing away from the drum container, one of the pair of strain gauges being attached to the first side and the other of the pair of strain gauges being attached to the second side. This arrangement requires no extra parts for attaching the strain-gauges, and utilizes the bending stresses generated in the spokes of the star-shaped support member.

In accordance with again an added feature of the invention, depending on the construction of the support structure, it can be more advantageous, if the bearing housing has an inner and an outer surface, one of the pair of strain gauges being attached to the inner surface and the other of the pair of strain gauges being attached to the outer surface. If the bearing housing is not excessively rigid, one can also detect measurable bending stresses there.

In accordance with again an additional feature of the invention, the drum has a pivot shaft and the carrier includes a drum container and a support bearing housing being connected to the drum container and having an inner wall and roller bearings disposed at a given height for supporting the pivot shaft, at least one of the piezo-electric pressure transducers being embedded in the inner wall at the given height. Depending on the type of the piezo-electric transducer used, this arrangement allows the determination of either absolute drum weights, for example by using a salt crystal, or weight changes can be sensed and determined by using a quartz crystal.

In accordance with a concomitant feature of the invention, the drum container has a rear wall, the laundry drum has a pivot shaft, and the carrier includes a star-shaped support member having spokes, a bearing housing and reinforcements connected therebetween, the support member being fastened to the rear wall and the pivot shaft being supported by the support member, at least one of the piezo-electric pressure transducers being embedded in at least one of the reinforcements, because the piezo-electric transducer devices can be very easily installed there.

Other features which are considered as characteristic for the invention are set forth in the appended claims.

Although the invention is illustrated and described herein as embodied in laundry treatment machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

The invention is only explained with reference to a front loading, drum-type washing machine. However, it can also be easily applied to other types of laundry machinery, such as tub-type washing machines, top-loading drum washing machines and drum-type driers.

Figure 2:
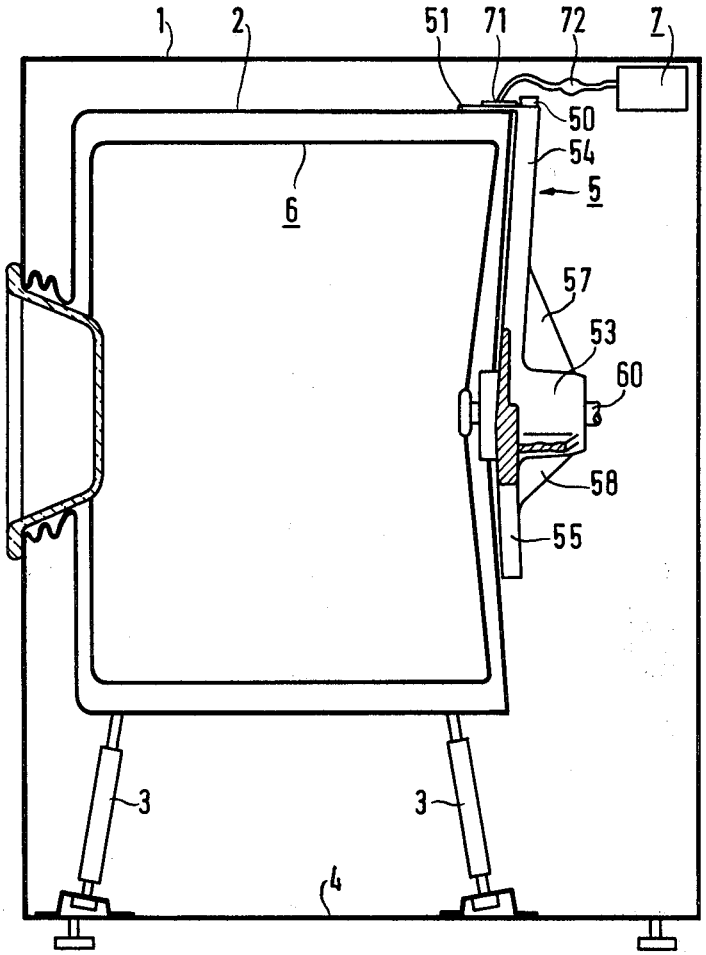
FIG. 2 is a cross-sectional view of the drum-type washing machine of FIG. 1 taken along the line II—II thereof in the direction of the arrows, as seen from the side with the side walls removed.
Figure 3:
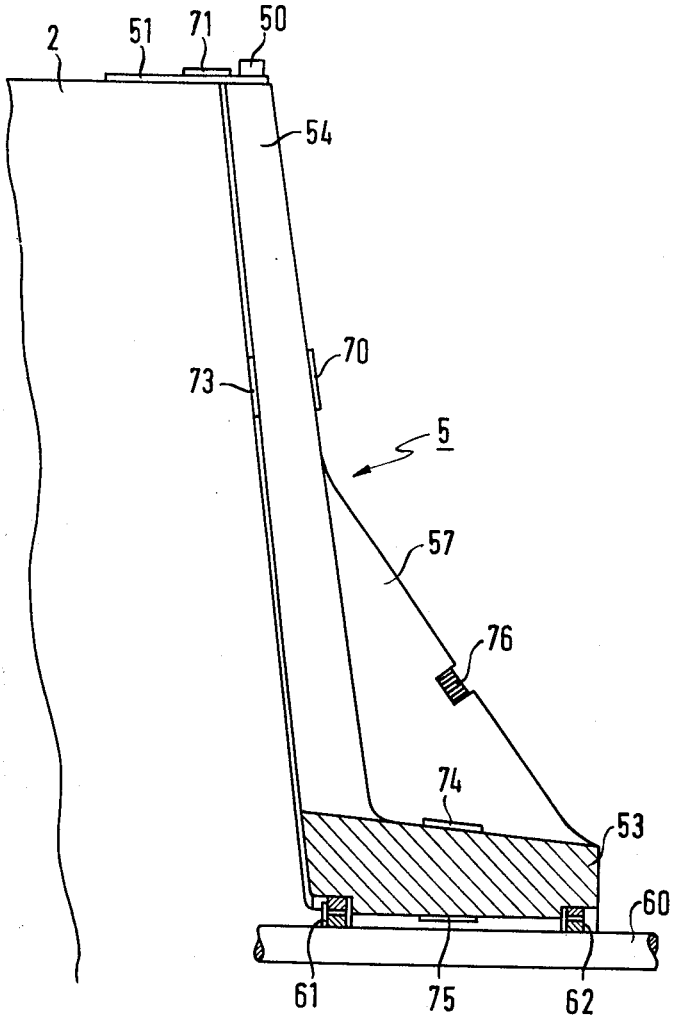
FIG. 3 is a fragmentary cross-sectional view taken through the rear part of a drum-type washing machine according to FIG. 1.
Figure 4:
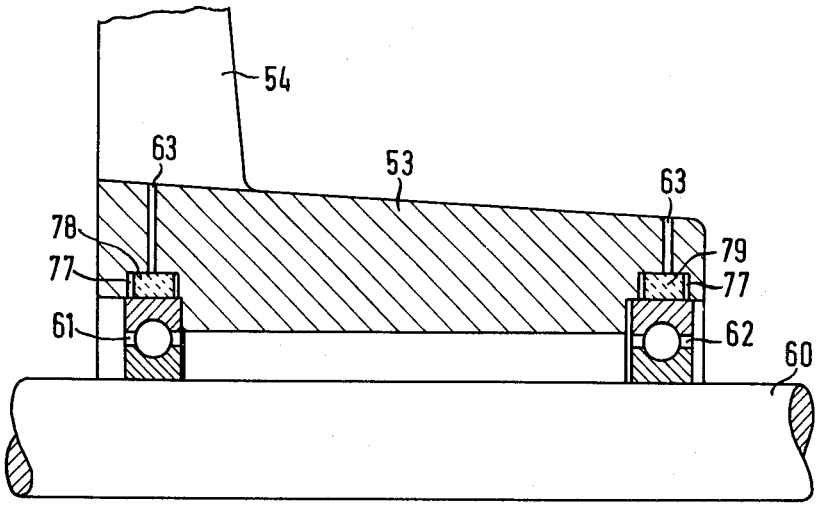
FIG. 4 is a fragmentary cross-sectional view taken through the bearing for the drum of a drum-type washing machine according to FIG. 1.

Referring now to the figures of the drawing as a whole, it is seen that a housing 1 encloses a drum container 2 which is supported by elastic and sometimes also by damping supports 3 at the bottom 4 of the housing. At the rear of the drum container 2, a star-shaped support member 5 is fastened by means of screws 50 and lugs 51 as seen in FIGS. 2 and 3, and also by screws 52. The drum container 2 and the support 5 from a carrier for a drum 6. In this way, the pivot shaft 60 of the washing drum 6 is supported on two roller bearings 61 and 62 as seen in FIGS. 3 and 4, in the bearing housing 53 of the star-shaped support member 5.

Figure 1:
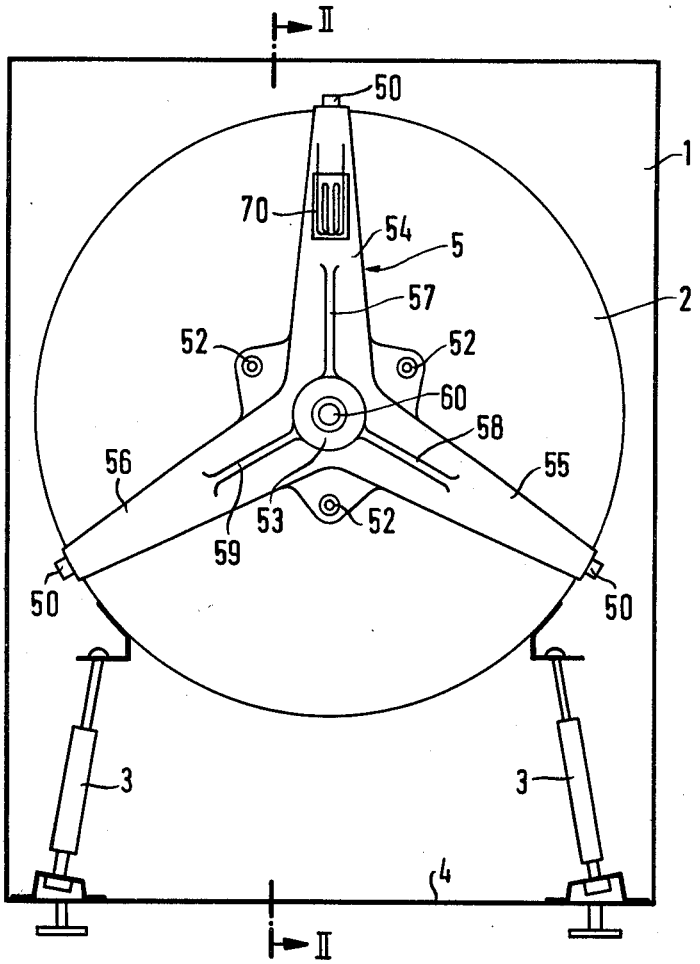
FIG. 1 is a diagrammatic rear elevational view of a front-loading, drum-type washing machine, with the back wall removed.

A strain gauge 70 is attached to one spoke 54 of three spokes 54 to 56 of the star-shaped support member 5, as shown in FIG. 1. The strain gauge reacts through a corresponding resistance change to a compression or tension of its associated spoke surface. Deviating from the illustrated embodiment, additional strain gauges can be attached to the other spokes 55 and 56, the effects of which are possibly opposite to the gauge 70 of spoke 54, so that an easily measured resistance difference is obtained.

Additionally or instead of the strain-gauge 70, one or more gauge 71 can be attached to the lugs 51 as shown in FIG. 2. The gauges are all connected by flexible lines 72 with a signal processing device 7. In the signal processing device 7, an evaluation circuit may be provided, similar to the circuit described and explained in German Published, Non-Prosecuted Application DE-OS 20 34 847.

In FIG. 3, it is seen that besides the hereinafore-described arrangement of the strain-gauge 71 on the lug 51, there are other strain gauges applied, either singly or in combinations. A strain gauge 70 is attached to the spoke 54 as in FIG. 1. Furthermore, another strain-gauge 73 is attached on the rear of the spoke which, during bending tensions in the rib 54 in the plane of the drawing, has the opposite effect of the strain-gauge 70. This means that its electrical resistance becomes less if the resistance of the strain-gauge 70 increases, and vice versa. The change of resistance from both strain gauges would therefore be doubly effective at the input of a non-illustrated differential amplifier in the signal processing device 7.

A pair of strain-gauge devices 74 and 75 attached to the outside and inside of the support housing 53 have a similar effect. Since the bearings 61 and 62 are usually spaced far enough apart, the torque moment generated by the pivot shaft 60 onto a suitably thin housing 53 can cause measurable bending stresses, which are sensed by the strain-gauge as the force causing the torque, and can be evaluated by the signal processing device.

The spokes 54 to 56 can be reinforced by means of triangular supports or gussets 57 to 59. These supports are also suited for holding sensors which pick up mechanical stresses.

Besides the use of strain-gauges, piezo-electric pressure sensors or transducers 76 can be provided in the material forming the star-shaped support member. As is known, the crystals of such sensors generate an electrical potential, if they are loaded by mechanical pressure in a certain direction.

In the embodiment as shown in FIG. 4, hollow spaces 77 are provided in the bearing shells of the bearing housing 53. The spaces are filled with the crystal devices or bodies 78 and 79 for the piezo-electric transducers, and are closed by the outer bearing rings of the roller bearings 61 and 62. During a load increase at the left-hand end of the pivot pin 60, as seen in FIG. 4, the crystal device 78 is less loaded, i.e. its electrical potential is reduced, and the crystal device 79 is more loaded, and therefore its electrical potential increases. The electrical lines can be conducted through suitable possibly shaft-shaped openings 63 to the signal processing device 7, and the difference between the electrical potentials can be evaluated as a measure for the weight change.

In all embodiments described hereinbefore, the important point is to sense an over-load at the end of the pivot shaft 60 at the drum side, the over load being added to the already existing weight of the drum, i.e. the individual weight of the laundry pieces loaded into the machine.

In one case the compression and tension stresses consequently occurring are measured in the support members (drum or wash-container 2, star-shaped support member 5) by strain-gauge or piezo-electric transducer devices, in the other case the occurring bearing force-changes are measured by piezo-electric transducer sensors.

The signals obtained from the measurement can on one hand be used to compensate for a proportional weight increase, and be considered for the selection of a suitable laundry treatment program.

On the other hand, the electrical signals derived from the weight change can be counted as digital signals after processing (electrically) and can be used in an electronic program selection computer for the automatic regulation of the required amounts of water, washing agent and energy.

There are claimed:

1. Laundry treatment machine comprising a housing, a carrier disposed in the housing, a laundry drum rotatably supported by said carrier, said carrier having parts thereof being exposed to loads affected by the weight of the drum, electromechanical transducers being disposed on said parts of said carrier and producing output signals representing a measure of the weight and the weight change of said drum, and a signal processing device receiving said output signals, said electromechanical transducers being in the form of strain gauges, and said carrier including a drum container for said drum and members connecting said drum to said drum container, at least one of said strain gauges being attached to said connecting members.

2. Laundry treatment machine according to claim 1, wherein said drum container has a bearing wall, said drum has a pivot shaft, and said carrier includes a star-shaped support member and lugs fastening said support member to said bearing wall for supporting said pivot shaft, at least one of said strain gauges being attached to said lugs.

3. Laundry treatment machine according to claim 1, wherein said drum container has a bearing wall, said drum has a pivot shaft, and said carrier includes a star-shaped support member having spokes and a bearing housing and being fastened to said bearing wall for supporting said pivot shaft, said strain gauges being provided in even numbered amounts and being attached in pairs to at least one of said spokes and bearing housing in such a way that each strain gauge of a pair is loaded with opposite effect relative to the other strain gauge of the pair by the weight of said drum.

4. Laundry treatment machine according to claim 3, wherein each of said spokes have a first side facing toward and a second side facing away from said drum container, one of said pair of strain gauges being attached to said first side and the other of said pair of strain gauges being attached to said second side.

5. Laundry treatment machine according to claim 3, wherein said bearing housing has an inner and an outer surface, one of said pair of strain gauges being attached to said inner surface and the other of said pair of strain gauges being attached to said outer surface.

6. Laundry treatment machine comprising a housing, a carrier disposed in the housing, a laundry drum rotatably supported by said carrier, said carrier having parts thereof being exposed to loads affected by the weight of the drum, electromechanical transducers being disposed on said parts of said carrier and producing output signals representing a measure of the weight and the weight change of said drum, and a signal processing device receiving said output signals, said electromechanical transducers being in the form of piezo-electric pressure sensors, said drum having a pivot shaft and said carrier including a drum container and a support bearing housing being connected to said drum container and having an inner wall and roller bearings disposed at a given height for supporting said pivot shaft, at least one of said piezo-electric pressure transducers being embedded in said inner wall at said given height.

7. Laundry treatment machine comprising a housing, a carrier disposed in the housing, a laundry drum rotatably supported by said carrier, said carrier having parts thereof being exposed to loads affected by the weight of the drum, electro-mechanical transducers being disposed on said parts of said carrier and producing output signals representing a measure of the weight and the weight change of said drum, and a signal processing device receiving said output signals, said electromechanical transducers being in the form of piezo-electric pressure sensors, said drum container having a bearing wall, said drum having a pivot shaft, and said carrier including a star-shaped support member having spokes, a bearing housing and reinforcements connected therebetween, said support member being fastened to said bearing wall and said pivot shaft being supported by said support member, at least one of said piezo-electric pressure transducers being embedded in at least one of said reinforcements.

* * * * *